United States Patent [19]

Honig

[11] Patent Number: 5,074,615

[45] Date of Patent: Dec. 24, 1991

[54] INTERCHANGEABLE LEFT-RIGHT HANDED CHAIR-DESK

[76] Inventor: David P. Honig, 3240 Henry Hudson Pkwy., Bronx, N.Y. 10463

[21] Appl. No.: 607,169

[22] Filed: Oct. 31, 1990

[51] Int. Cl.[5] ..... A47B 83/02

[52] U.S. Cl. ..... 297/161; 297/162

[58] Field of Search ..... 297/160, 161, 162, 173, 297/174

[56] References Cited

U.S. PATENT DOCUMENTS

| | | | |
|---|---|---|---|
| 1,231,301 | 6/1917 | Schlanger | 297/161 |
| 1,864,750 | 6/1932 | Moore | 297/162 X |
| 4,427,232 | 2/1981 | Malm . | |
| 4,591,206 | 5/1986 | Pribble | 297/161 X |
| 4,925,240 | 5/1990 | Peters | 297/161 |

*Primary Examiner*—Peter A. Aschenbrenner
*Attorney, Agent, or Firm*—Milton L. Honig

[57] ABSTRACT

A chair-desk is described having a reversible construction adapted for use by both left and right handed persons. The chair-desk comprises an L-shaped tablet having a pair of opposing surfaces defining a flat writing area. A projection extends from an end of the tablet in a direction perpendicular to a back of the chair. A channel cut into the chair back receives the projection and serves as a guide permitting the tablet to be shifted from a right to left side of the chair and the writing surfaces to be rotated by 180°.

17 Claims, 4 Drawing Sheets

INTERCHANGEABLE LEFT-RIGHT HANDED CHAIR-DESK

BACKGROUND OF THE INVENTION

1. Field of the Invention

The invention relates to a chair-desk having an L-shaped tablet arm that can be converted to accommodate a right or left handed person.

2. The Related Art

Schools and other institutions are often equipped with chair-desk combinations which have L-shaped tablets as writing surfaces. Invariably the tablet is oriented for the convenience of right handed persons. A significant percentage of the population, however, writes left handed. For the minority, the customary chair-desk design is quite uncomfortable. This presents a special handicap, for instance when taking lengthy tests.

Even in those rare instances where left handed chair-desks are available, it is difficult to know how many will be needed for any particular group of persons. There will either be too many or too few.

U.S. Pat. No. 4,427,232 (MALM) recognized this problem. Therein is reported a reversible chair-desk construction having a generally horizontal seat surface, vertically extending seat back, and a generally planar tablet with two opposed sides defining a writing surface. Means for accomplishing pivotal movement connect an arm of the tablet to the back of the chair. Pivotal movement of the tablet occurs about a substantially horizontal axis generally medially of the back and substantially transverse thereto. The pivotal movement means allows the tablet to be swung to either side of the seat. A support for the tablet rises upward in the form of an arm flanking each side of the horizontal seat surface.

Although simple in structure, the design of MALM presents certain difficulties for a user. Access to the seat surface is hindered. Entry from the front is blocked by the tablet. Side entry is blocked by the upwardly rising support arms. Thus, improvements are still necessary to achieve a fully functional chair-desk combination.

Accordingly, it is an object of the present invention to provide a chair-desk having an L-shaped tablet that can serve as a writing surface for both left and right handed persons.

Another object of the present invention is to provide a chair-desk having an L-shaped tablet and a seat surface easily accessible from at least a side opposite the tablet, the tablet being movable from one side to another to accommodate left and right handed persons.

SUMMARY OF THE INVENTION

A chair-desk is provided adapted for use by both left and right handed persons, comprising:

- a seat oriented horizontally and having front, rear, left and right sides;
- a back extending vertically upwards from the rear side of the seat;
- an L-shaped tablet having an end adjacent the back, a side edge and two opposing surfaces each defining a writing surface and oriented parallel to the seat;
- a projection extending from the end of the tablet;
- a means along the back for receiving the projection and serving as a guide for allowing the projection and thereby the tablet to be slidably shifted from a right to a left side of the chair-desk.

Advantageously the means along the back is a channel cut therethrough from near one edge of the back to another. This channel may either be straight or trace a semi-circular arc. An end segment of greater vertical height than that of the channel may be located at either terminus thereof. The end segment is adapted to receive an end section of a leg of the tablet. The end section should have a width just slightly smaller than that of the end segment to achieve a snug fit. Support is thereby provided to the tablet. Moreover, the end section should have a height larger than that of a central segment of the channel, the latter being positioned between the terminus end segments. Movement of the end section and thereby the tablet across the back is consequently hindered.

The projection extending from the end of the tablet should have a cross sectional width smaller than any height defining the channel. Travel of the tablet from one to another terminus along the channel can only occur by sliding the tablet via the projection. A round cross section is most preferred although any polygonal cross section would also be operative with certain provisos. One important proviso is that the polygonal structure, similar to a round one, must be rotatable by at least 180° within the channel. Rotatability is necessary to allow reversal from one tablet writing surface to the other.

A locking means can be provided for securing the end section against slippage out of the end segment. The locking means is positioned on an end of the projection distant from the tablet. Consequently, the locking means will be situated on a side of the back opposite to a side facing the tablet. Specifically, the projection may be in the form of a section of threaded bolt while the locking means may be a threaded nut (e.g. wing nut) tightenable on the bolt against a surface of the back. An alternate locking means may comprise a spring interposed between a stop, wider than the projection cross section, and the surface of the back. The stop may be movable along the projection (e.g. threaded nut along bolt) or may simply be stationary. Through use of the spring, it becomes relatively easy to disengage the tablet from the travel prevention segment of the channel.

Frontal support should also be provided to the tablet. A means for frontally supporting the tablet can be provided along the side edge thereof that faces outwardly away from the seat.

Two features must be included within the means for frontal support. The means must be able to pivot at least 180°. Secondly, the means must be attached to the side edge of the tablet so as to travel therewith when the latter is also caused to rotate for reversing the writing surfaces.

Specifically, the frontal support means may comprise a pivot device attached to the side edge, a connecting bar pivotally communicating with the pivot device, and a seat latch. On both left and right sides of the seat will be positioned a latch receiver cooperating and allowing engagement with the seat latch. A hook and semi-circular hollow structure may serve as the seat latch and latch receiver, respectively. None of the means for frontally supporting the tablet should protrude from either of the tablet writing surfaces; the surfaces should remain smooth planar whether facing upwards or downwards. It is, however, possible to embed a support rod within the tablet plane parallel to the back that interconnects with pivot device and connecting bar.

Alternatively, the means for frontally supporting the tablet can comprise a hinge connector attached to the side edge, a plate pivotally communicating with the hinge connector, and a seat latch. A downwardly facing U-shaped groove opening at a lower end of the plate may serve as the seat latch. Outwardly protruding from each side of the seat may be a threaded bar, serving as a latch receiver, capable of fitting within the U-shaped groove. A threaded wing nut can be employed to secure groove to protruding bar.

Operation of the chair-desk will now be described. Interconversion begins with disengagement of the seat latch from the latch receiver. This frees the connecting bar which is then rotated in a plane transverse to the back and away from the latch receiver. Full 180° rotation may immediately be performed or done subsequently to the succeeding steps.

Now the locking means is disengaged, e.g. the wing nut is loosened. The tablet is then pulled in a forward direction away from the back sufficiently to remove the end section from its anchor in the channel end segment and cause the projection with its smaller cross section to be the only part lying within the channel. Thereafter, the tablet is moved from one terminus of the channel to the other and rotated 180° around an axis of the projection. Thereby the writing surfaces will be interchanged in their face upwards/downwards position. Rotation may either precede, follow or be simultaneously with the movement along the channel. Then the tablet is pushed in a direction toward the back to establish an anchor in the channel end segment at the opposite terminus from the disengaged one. Locking means are then reapplied. Finally, the seat latch is engaged with the latch receiver opposite from the earlier disengaged one.

BRIEF DESCRIPTION OF THE DRAWING

The above features, advantages and objectives of the present invention will more fully be appreciated through the following detailed discussion, reference being made to the drawing consisting of.

DETAILED DESCRIPTION

Figure 1:
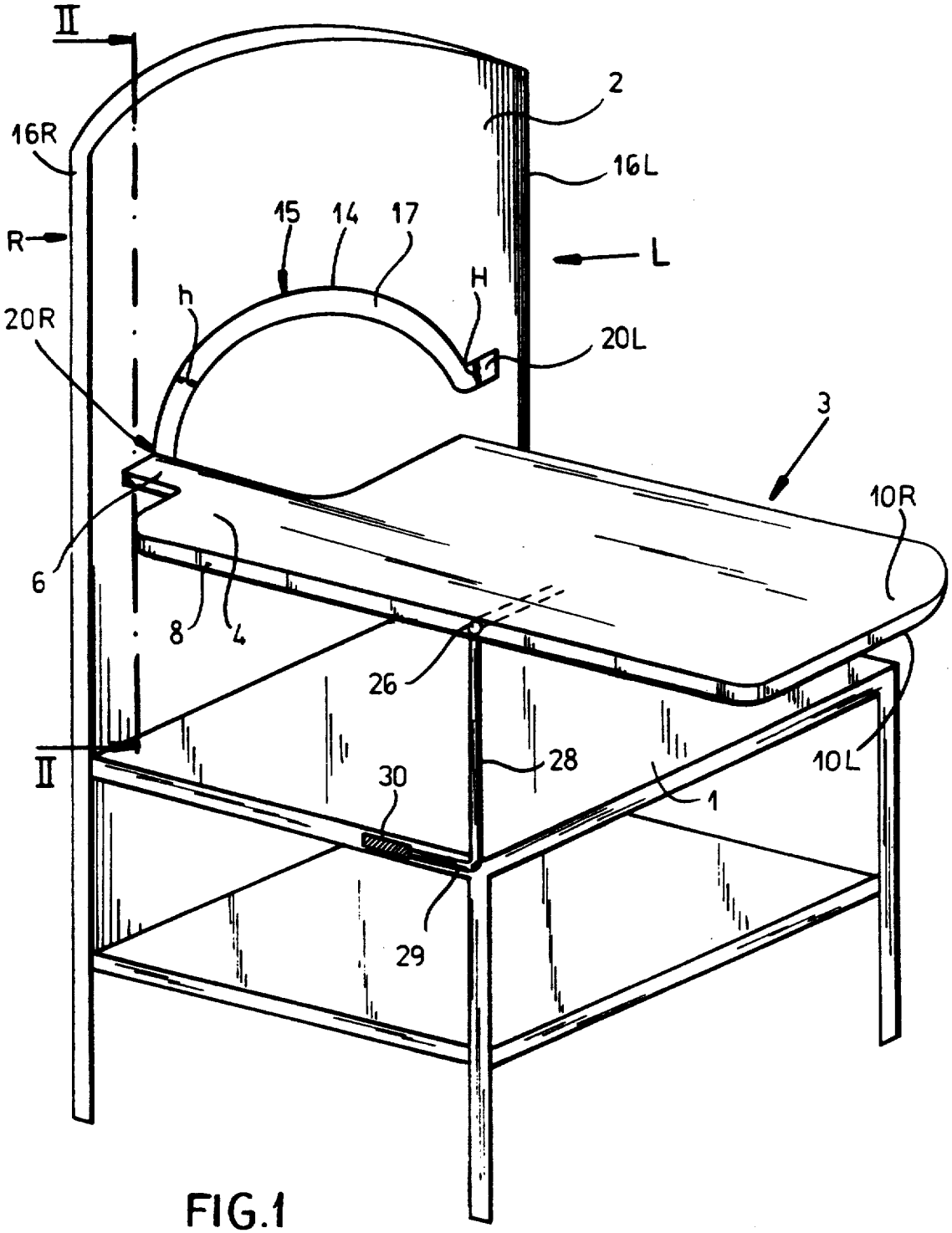
FIG. 1 which is a plan perspective view of the chair-desk.
Figure 2:
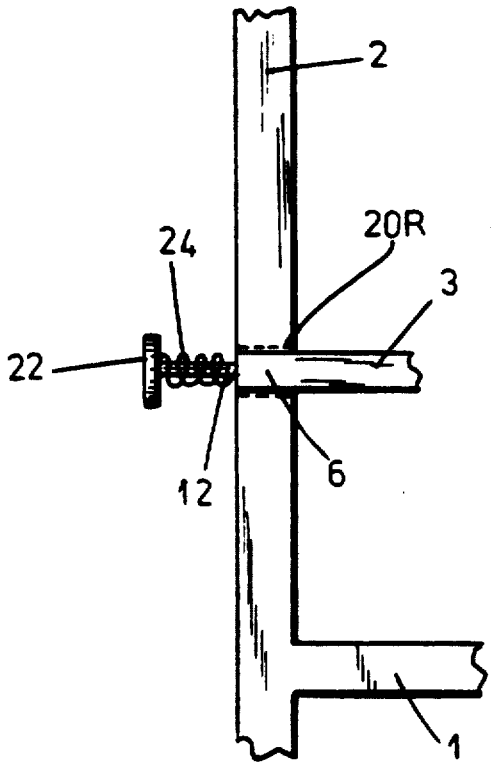
FIG. 2 which is a partial and enlarged cross-sectional view along lines II—II of FIG. 1.
Figure 3:
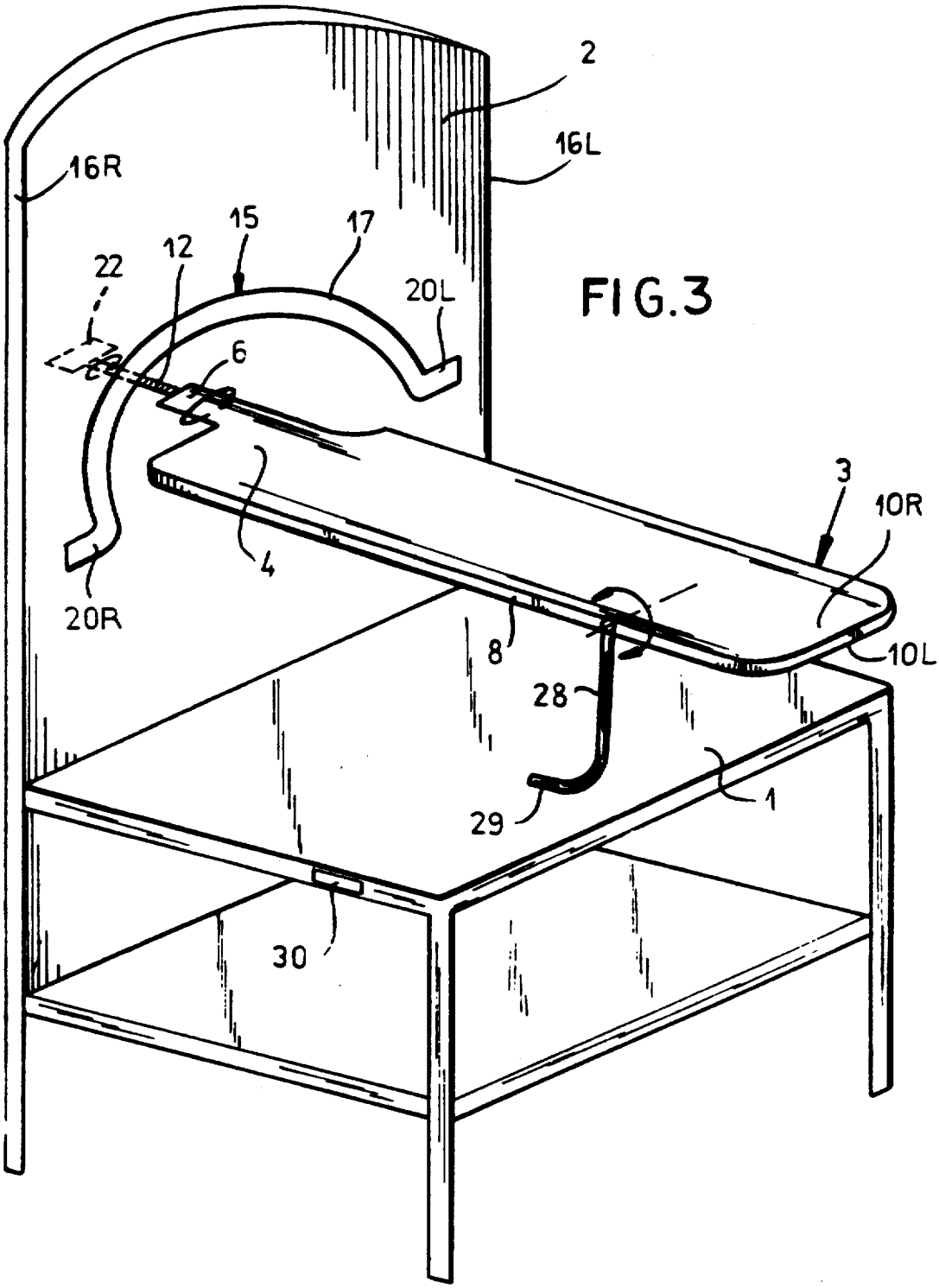
FIG. 3 which is similar to FIG. 1 but illustrating the rotational and translational motion of the tablet.

The chair-desk of the present invention as shown in FIG. 1 includes as the major structures a seat 1, a back 2 and an L-shaped tablet 3. Seat 1 is oriented generally horizontally relative to the ground upon which the chair rests. Back 2 extends vertically upwards from a rear side of seat 1. The L-shaped tablet 3 has a leg portion 4 with an end section 6 thereof adjacent back 2, a side edge 8 and two opposing surfaces 10R, 10L, each of which define a writing surface. A projection 12 extends from the end section 6 of the tablet 3. Along the back 2 is provided a guide system 14 for receiving projection 12. By means of the guide system 14, projection 12 and thereby tablet 3 can be shifted from a right side (R) to a left side (L) of the chair and vice versa.

The guide system 14 includes a channel 15 cut through the thickness of the back 2 from near one edge 16R of the back to another 16L. Preferably each end of channel 15 will be about 0.5 to about 6 inches away from respective edges 16R, 16L. Channel 15 may follow either a straight or curved track. FIG. 1 illustrates a curved track. An end segment 20R, 20L of greater vertical height H than a height h of a central segment 17 is located at each terminus of the channel. End segments 20R, 20L are adapted to receive the end section 6 of the L-shaped tablet. Since each end section 6 has a height greater than h but less than H movement of the end section and thereby movement of the tablet is prevented. End section 6 should have a width slightly smaller than that of the end segments. A tight fit results which provides rear support for the tablet. Projection 12 should have a cross-section width w smaller than any height H or h defining channel 15.

Travel of the tablet from one terminus of channel 15 to the other can only occur when projection 12 with its small cross section width is engaged within channel 15. A threaded bolt is quite suitable as a projection 12.

Locking means to secure end section 6 against slippage out of the end segment 20R, 20L can be provided by a wing nut 22 engageable on bolt projection 12. Tightening of wing nut 22 against back 2 locks the end section 6 into position. Alternatively or in combination with bolt and nut arrangement, a spring 24 may encompass projection 12 between the wing nut 22 (or equivalent wide stop) and back 2.

Frontal support for tablet 3 may be provided by a pivot device 26, a connecting bar 28 and a seat latch 29. Pivot device 26 is attached to side edge 8 of tablet 3. Connecting bar 28 pivotally communicates with the pivot device 26. The connecting bar 28 must be capable of undergoing a pivot arc of at least 180°. Seat latch 29 in hook shape is formed at a lower end of connecting bar 28. On both left and right sides along respective edges of seat 1 is positioned a respective seat receiver 30 to accept engagement with seat latch 29.

Figure 4:
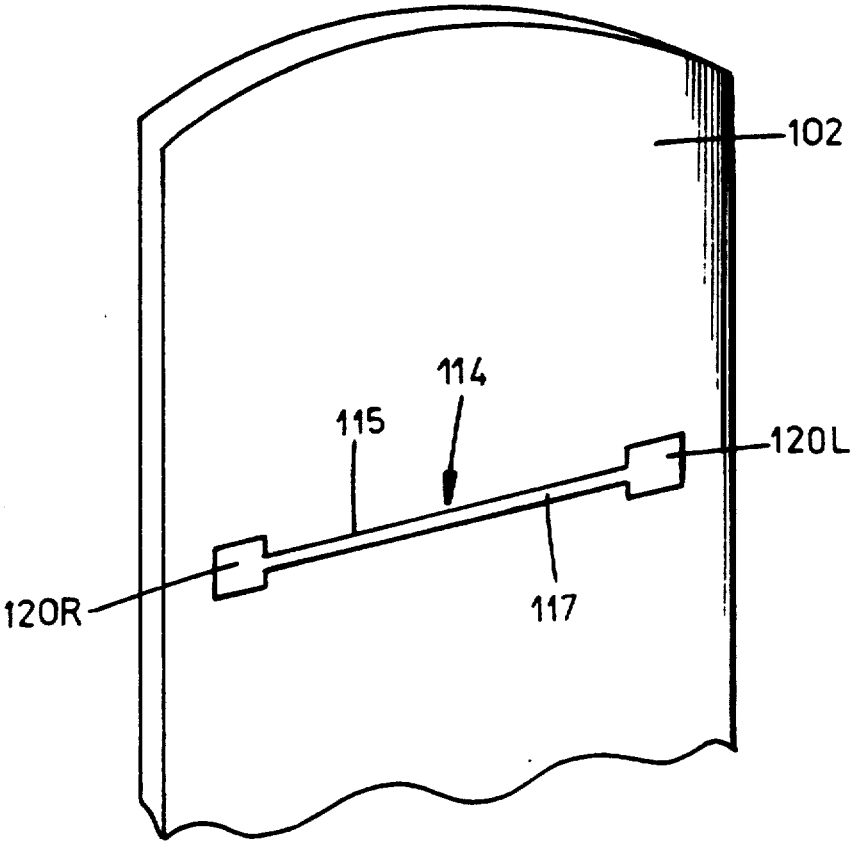
FIG. 4 which is a partial view of the chair-desk back showing a channel tracing a straight path for the guide system.

FIG. 4 illustrates a modification of the guide system 114 with a straight channel 115 including a central segment 117 and end segments 120R, 120L cut through chair back 102.

I claim:

1. A chair-desk adapted for use by both left and right handed persons, comprising:
   - a seat oriented horizontally and having front, rear, left and right sides;
   - a back extending vertically upwards from said rear of said seat;
   - an L-shaped tablet having an end adjacent said back, a side edge and two opposing surfaces each defining a writing surface and oriented parallel to said seat;
   - a projection extending from said end of said tablet;
   - a means along said back for receiving said projection and serving as a guide for allowing said projection and thereby said tablet to be slidably shifted from a right to a left side of the desk-chair.

2. A chair-desk according to claim 1, wherein said means along the back is a channel cut therethrough from near one edge of said back to another.

3. A chair-desk according to claim 2, wherein said channel traces a straight path.

4. A chair-desk according to claim 2, wherein said channel traces a semi-circular arc.

5. A chair-desk according to claim 2, wherein said channel includes an end segment located at each terminus of said channel.

6. A chair-desk according to claim 1, wherein said tablet includes a leg having an end section whose width is just slightly smaller than that of said channel end segment and fits snugly therein.

7. A chair-desk according to claim 5, wherein said channel has a central segment positioned between said terminii end segments and said end section has a height larger than a height of said central segment.

8. A chair-desk according to claim 1, wherein said tablet at an end thereof includes means for preventing movement of said tablet across said back.

9. A chair-desk according to claim 2, wherein said projection has a cross sectional width smaller than any height defining said channel.

10. A chair-desk according to claim 9, wherein said projection is rotatable by at least 180° within said channel.

11. A chair-desk according to claim 6, further comprising a locking means for securing said end section against slippage out of said end segment of said channel.

12. A chair-desk according to claim 11, wherein said locking means is positioned on an end of said projection distant from said tablet.

13. A chair-desk according to claim 12, wherein said projection is a threaded bolt and said locking means is a threaded nut tightenable on said bolt against said back.

14. A chair-desk according to claim 11, wherein said locking means is a spring interposed between a stop and a surface of said back said spring being wider than said cross section of said projection.

15. A chair-desk according to claim 1, further comprising a support means for said tablet, said means being able to pivot at least 180° and being attached to a side edge of said tablet so as to travel therewith when said tablet is caused to rotate to reverse said writing surface.

16. A chair-desk according to claim 15, wherein said support means comprises a pivot device attached to a side edge of said tablet, a connecting bar pivotally communicating with said pivot device and a seat latch.

17. A chair-desk according to claim 15, further comprising means on said seat for cooperating with and allowing engagement of said seat latch therewith.

* * * * *